United States Patent [19]

Newkirk et al.

[11] 4,430,406

[45] Feb. 7, 1984

[54] FUSER MEMBER

[75] Inventors: James S. Newkirk, LeRoy; Robert A. Wiederhold, Rochester, both of N.Y.

[73] Assignee: Eastman Kodak Company, Rochester, N.Y.

[21] Appl. No.: 313,914

[22] Filed: Oct. 22, 1981

[51] Int. Cl.[3] ..... B21B 31/08; B05D 1/02; B05D 1/34

[52] U.S. Cl. ..... 430/99; 29/130; 29/132; 427/194; 427/425; 427/426; 427/409; 118/60; 428/422; 428/451; 428/212

[58] Field of Search ..... 29/130, 132; 427/194, 427/425, 421, 426, 409; 118/60; 219/216; 428/422, 212, 448, 447, 451; 430/99

[56] References Cited

U.S. PATENT DOCUMENTS

| | | | |
|---|---|---|---|
| B 425,770 | 1/1975 | Thettu | 29/130 |
| T934,010 | 5/1975 | Maskoenick | 29/130 |
| 2,852,415 | 9/1958 | Colbert et al. | 117/211 |
| 3,009,209 | 11/1961 | Weinbrenner et al. | 18/58 |
| 3,020,182 | 2/1962 | Daniels | 154/53 |
| 3,291,466 | 12/1966 | Aser et al. | 263/6 |
| 3,449,548 | 6/1969 | Adamek et al. | 219/216 |
| 3,452,181 | 6/1969 | Stryjewski | 219/216 |
| 3,776,760 | 12/1973 | Baker et al. | 29/132 |
| 3,849,062 | 11/1974 | Thettu et al. | 432/60 |
| 3,849,128 | 11/1974 | Ihara | 117/34 |
| 3,852,861 | 12/1974 | Baker et al. | 29/132 |
| 3,883,293 | 5/1975 | McCarroll | 432/60 |
| 3,912,901 | 10/1975 | Strella et al. | 219/216 |
| 3,948,214 | 4/1976 | Thettu | 118/60 |
| 3,967,042 | 6/1976 | Laskin et al. | 428/422 |
| 3,988,817 | 11/1976 | Thettu | 29/130 |
| 4,064,313 | 12/1977 | Takiguchi et al. | 427/22 |
| 4,092,953 | 6/1978 | Waugh | 118/642 |
| 4,098,631 | 7/1978 | Stryjewski | 156/211 |
| 4,375,505 | 3/1983 | Newkirk | 427/421 |

FOREIGN PATENT DOCUMENTS

| | | |
|---|---|---|
| 136080 | 7/1947 | Australia . |
| 1456237 | 11/1976 | United Kingdom . |
| 1456238 | 11/1976 | United Kingdom . |
| 1456239 | 11/1976 | United Kingdom . |

OTHER PUBLICATIONS

Product Licensing Index, Jul. 1972, Research Disclosures, Electrographic Fusing Apparatus, pp. 72 & 73.

Japanese Publication No. 41330/79, 9/5/73.

*Primary Examiner*—Shrive P. Beck

*Attorney, Agent, or Firm*—William F. Noval

[57] ABSTRACT

A fuser member has a composite layer including (1) a first layer of a first material which is an elastomer; (2) a second layer of a second material which is preferably a fluoroelastomer which is impervious to fuser oil absorbed by said first material; and (3) a layer intermediate to and continuous with the first and second layers in which the proportion of the first material to the second material gradually varies from substantially only the first material to substantially only the second material.

Methods of making the fuser member by a spray technique and of using the fuser member to fuse toner images to a receiver are also disclosed.

40 Claims, 6 Drawing Figures

FUSER MEMBER

BACKGROUND OF THE INVENTION

This invention relates generally to the field of electrography and more particularly, this invention relates to the fusing of toner images to receivers by means of heat and pressure.

In the field of electrography, as practiced, for example, in commercial copiers, a radiation image of an original to be reproduced is projected upon a uniformly charged photoconductive member to produce a latent electrostatic image corresponding to the original image. A visible toner image is produced by developing the electrostatic image with charged toner particles. If the photoconductive member is reusable in the form of a belt or drum, the toner image is then transferred to a receiver such as a web or sheet of plain paper and fused to the receiver. If the photoconductive member itself is the receiver, then the toner image is fused directly to the member.

One technique which may be used to fuse a toner image to a receiver is through the application of heat and pressure by contacting the toner image with a heated fuser member such as a roller or belt. Commonly, a pair of rollers held together under pressure form a nip through which a toner image carrying receiver is passed. One or both of the rollers are heated to melt the heat softenable toner particles to fuse the toner image to the receiver.

In such fusers, one or both rollers preferably include an elastomeric layer to lengthen the nip through which the toner image passes in order to increase fusing time and to lower fusing energy requirements. The elastomeric layer should be resistant to degradation at high temperatures over a long operating life. In addition, the surface of the fuser roller contacting the toner image should be of a material having good release characteristics to prevent offset of toner particles onto the surface of the fuser roller and to obviate the tendency of the copy sheet to wrap around one of the rollers causing copier malfunction. Although silicone elastomers and fluoroelastomers exhibit good resistance to degradation at high temperatures as well as good release characteristics, it has been found necessary to apply a coating of fuser oil to the fuser roller in order to eliminate any possibility of offset to the roller of contaminants such as toner, paper particles, etc. Thus, various fuser oils such as fluorocarbon oils, silicone oils, and fluorosilicone oils may be applied to the fuser roller to improve its toner offset preventing characteristics.

Additionally, in commercial electrographic copiers which process several thousand copy sheets per hour, it is highly desirable that the fuser be capable of operating over a long life so that the operation of the machine is not interrupted by fuser paper jams or replacement of a defective fuser component. Fusers including a silicone elastomer roller to which silicone fuser oil is applied in combination with a fluoropolymer-coated metallic pressure roller have succeeded in minimizing paper jams caused by toner offset and in increasing the operating life of the fuser. Over a period of time, however, the silicone fuser oil tends to be absorbed into the silicone elastomer causing it to swell. This swell may cause the growth of a step pattern in the roller if copy sheets of a variety of lengths are processed by the copier. These steps are formed by greater swelling due to fuser oil absorption beyond the areas of the roller used to process the shorter length copies. When longer length copies are passed through the nip of the roller fuser, uneven fusing causes image deterioration in the processed copy sheet and damage to the sheet. Since image deterioration is undesirable, the roller fuser member may have to be replaced necessitating a service call and incapacitating the copier for several hours with attendant inconvenience, frustration and cost. Step growth pattern in elastomeric fuser rollers has been found to be especially persistent when both fuser roller members are provided with elastomeric layers as when processing copy sheets with unfused toner images on both sides of the sheet.

Swelling of the silicone elastomeric layer by absorption of silicone fuser oil may be minimized by providing a multi-layer fuser member wherein the silicone elastomeric layer is overcoated with a layer of material which is resistent to absorption of silicone fuser oil. Such silicone oil resistant materials include the fluoroelastomers such as fluorosilicone elastomer and fluoropolymer-based elastomers such as various vinylidene fluoride-based elastomers which contain hexafluoropropylene as a comonomer, for example, Viton• A (vinylidene fluoride-hexafluoropropylene) and Viton• B (vinylidene fluoride- hexafluoropropylene-tetrafluoroethylene) which are available from the Dupont Company. Viton• is a trademark of DuPont. Such materials are substantially more resistent to silicone fuser oil absorption than silicone elastomer and substantially decrease the forming of steps in the silicone elastomeric underlayer. In order to increase the release characteristics of the fuser roller, a thin coating of silicone elastomer may be applied to the fluoroelastomer to form a three-layered fuser member.

Although the aforementioned multilayer fuser rollers have been found to minimize the formation of steps and consequent image degradation in processed copy sheets, thereby substantially increasing the life of the fuser roller, it has been found difficult to form the multilayered fuser members due to the difficulty in adhering fluoroelastomers to silicone elastomers. Thus, a fuser roller having a silicone elastomer base layer to which is adhered a fluoroelastomer layer has been found to exhibit separation between the layers with prolonged use. This separation may be accounted for by the lack of affinity of the fluoroelastomers for other materials and by the constant flexing of the fuser roller during use.

As a consequence of the foregoing problems associated with known fuser members, the need has been present for a fuser member to which fuser oil may be applied without swelling of the member and resultant step formation therein. The member should have a long operating life and be able to function at high fusing temperatures without structural failure. A multilayered fuser roller should not have interlayer separation over its useful life.

SUMMARY OF THE INVENTION

In accordance with the present invention, there is provided an improved fuser member and method of making and using such member which is resistent to the formation of steps in the surface of the member caused by the absorption of fuser oil applied to it. The fuser member is provided with a long life capable of processing several hundred thousand copy sheets without a noticeable deterioration in the image quality of fused images and without damage to the sheets.

According to one aspect of the invention, a method of forming a member for fusing toner images to a receiver is provided in which a base member is sprayed with a first material which is an elastomer. After a layer of the first material is formed, the first material is continued to be sprayed while spraying a gradually increasing proportion of a second material with the first material until only the second material is sprayed. Spraying of the second material is thereafter continued to form a layer of only the second material. Preferably both the first and second materials are high-temperature resistant elastomers and the second material is resistant to absorption of fuser oil to act as a barrier to absorption of fuser oil by the first material.

According to another aspect of the invention, a fuser member is provided which has a composite layer including (1) a first layer of a first material which is an elastomer; (2) a second layer of a second material different from the first material; and (3) a layer intermediate to and continuous with the first and second layers in which the proportion of the first material to the second material gradually varies from substantially only the first material to substantially only the second material. Preferably both the first and second materials are high-temperature resistant elastomers and the second material is resistant to absorption of fuser oil to prevent absorption of fuser oil by the first material. According to another aspect of the invention the fuser member comprises a fuser roller having a composite layer as described above.

Another aspect of the invention provides a method for fusing toner images to a receiver by contacting a toner image with a fuser member having a composite layer as described above.

The invention and its features and advantages will be set forth and become more apparent in the detailed description of the preferred embodiment presented below.

BRIEF DESCRIPTION OF THE DRAWINGS

In the detailed description of the preferred embodiment of the invention presented below, reference is made to the accompanied drawings in which.

DESCRIPTION OF THE PREFERRED EMBODIMENTS

Figure 1:
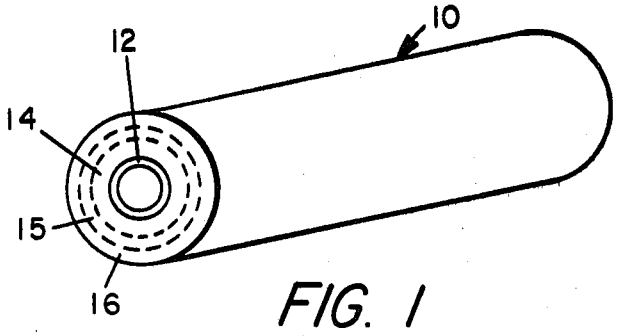
FIG. 1 is one embodiment of a fuser roller member according to the present invention.

According to the present invention, multilayer fuser members of different configurations may be provided. For example, the fuser member may comprise a flat plate, a belt, or a roller. However, in commercial electrophotographic copiers, the most common configuration of fuser member is a roller. Accordingly, the embodiment shown in FIG. 1 includes a fuser roller 10 which may be heated internally. Roller 10 includes a core 12 of heat conductive material such as aluminum, brass or stainless steel or heat transmissive material such as glass. A composite layer bonded to core 12 includes layers 14 and 16 of elastomeric materials which are resistant to degradation at high temperatures, e.g. in the range of 100° C. to 200° C. According to one embodiment of the present invention, the material of layer 14 is a polysiloxane elastomer such as silicone elastomer. The material of layer 16 is preferably an elastomer which resists absorption of silicone fuser oil and may, for example, comprise a fluoroelastomer such as fluoro-silicone or a fluoropolymeric elastomer such as the vinylidene-fluoride based fluoropolymers.

According to the present invention, a layer 15 is intermediate to and continuous with layers 14 and 16 and comprises a gradually varying mixture from only the material of layer 14 to only the material of layer 16. Layer 14 may be previously formed on core 12 by known techniques such as molding, before application of layer 16 or layer 14 may be formed during the process in which layer 16 is formed. Where a thickness of layer 14 has already been formed on core 12, preferably a thin coating of the same elastomer as layer 14 is initially sprayed onto layer 14 to form a continuous layer therewith. While the material of layer 14 is continued to be sprayed, the material which is to form layer 16 is simultaneously sprayed in gradually varying proportion with the layer 14 material. As spraying continues, the proportion of the layer 14 material decreases while the proportion of layer 16 material increases until only the layer 16 material is being sprayed. Only this material is then sprayed to the desired thickness of layer 16. Alternatively, the layer 14 material may be sprayed directly upon core 12 and a desirable thickness thereof built up before the formation of layer 15 is initiated.

The gradually varying layer 15 formed between layers 14 and 16 may be effected in several ways. In one method, the proportion of the layer 14 material and the layer 16 material being sprayed is continuously changed so that initially only layer 14 elastomer is sprayed and finally only layer 16 elastomer is being sprayed with the proportion of the two materials continuously varying during the spraying process so that the proportion of the layer 16 material to layer 14 material gradually increases. In another method, the proportions are changed in fixed steps so that, for example, initially only layer 14 elastomer is sprayed; then say, a mixture of 75% of layer 14 elastomer and 25% of layer 16 elastomer is sprayed; then a mixture of 50% of each elastomer is sprayed; then a mixture of 25% of layer 14 elastomer and 75% of layer 16 elastomer is sprayed; and then only layer 16 elastomer is sprayed. Other variations in the proportions of materials and number of layers may be effected within the scope of the present invention.

The layer 14 elastomer and layer 16 elastomer are preferably dissolved in the same solvents or solvents or insolvents in which both elastomers are soluble prior to spraying in order to maximize compatability of the materials once sprayed on the roller. The solvents used are preferably a suitable mixture of low boiling point and high boiling point solvents, the ratio of one solvent to another being selected to obtain proper drying time to insure acceptable roller properties such as the ability to resist delamination between layers.

Figure 2:
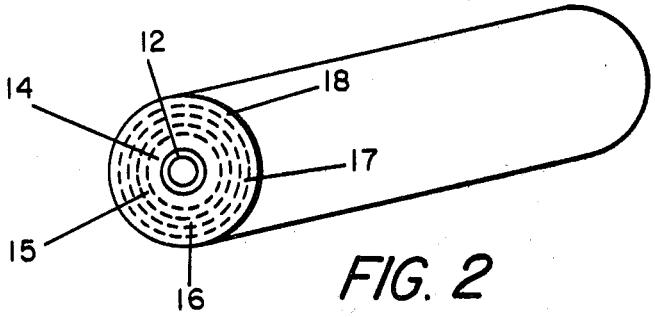
FIG. 2 is another embodiment of a fuser roller member according to the present invention.

In the embodiment of FIG. 2, a third layer 18 of toner offset preventing elastomer is provided which contacts a toner image carried by a receiver. A layer 17 is intermediate to and continuous with layers 16 and 18 and comprises a gradually varying proportion of the layer 16 elastomer and the layer 18 elastomer from substantially only the layer 16 elastomer to substantially only the layer 18 elastomer. The elastomer of layer 18 is preferably the same as the elastomer of layer 14 and may, for example, comprise silicone elastomer. Layer 16 is preferably of fuser oil resistant elastomer such as fluoroelastomer and substantially prevents any oil absorbed by layer 18 from penetrating to layer 14 and thereby swelling it.

Figure 3:
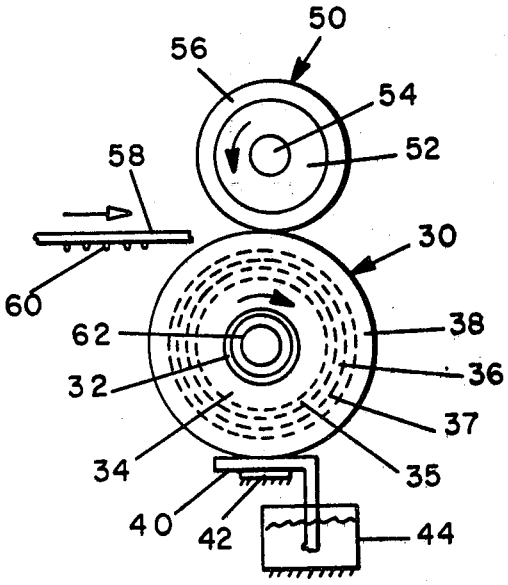
FIG. 3 shows the fuser member of FIG. 2 as used in a roller fuser for fixing simplex images.

Referring now to FIG. 3, there is shown a fuser roller according to the embodiment of FIG. 2 incorporated into a roller fuser used in an electrographic copier for fusing receivers carrying toner images on one side thereof. As shown, roller 30 includes a metallic core 32; a first layer 34 of high-temperature resistant silicone elastomer bonded thereto; a second layer 36 of elastomer which is impervious to silicone fuser oil and resistant to degradation at high temperatures such as fluorosilicone or a fluoropolymeric elastomer such as the vinylidene-fluoride basd fluoropolymeric elastomers; and a layer 35 intermediate to and continuous with layers 34 and 36 in which the proportion of the silicone elastomer to the fluoroelastomer gradually varies from substantially only the silicone elastomer to substantially only the fluoroelastomer. A third layer 38 is provided which may be any high temperature resistant material which has good toner offset preventing characteristics. Preferably layer 38 is of the same material as layer 34 and therefore may comprise silicone elastomer. However, this material may be any other high temperature resistant elastomer which shows good toner offset preventing characteristics or may be a flexible polymer which is not elastomeric by which has good toner offset preventing characteristics and which is heat resistant, such as the fluoropolymer which comprises a copolymer of tetrafluoroethylene and polypropylene.

Layer 37 is intermediate to and continuous with layers 36 and 38 in which the proportion of the layer 36 material to the layer 38 material gradually varies from substantially only the layer 36 material to substantially only the layer 38 material.

In order to enhance the toner offset preventing characteristics of the surface of layer 38, fuser oil is applied by means of a wick 40 held against roller 30 by member 42. Wick 40 is saturated with fuser oil contained in sump 44. A large number of known fuser oils are commercially available and suitable for such use. For example, a series of silicone glycol copolymer liquids as well as an alkylaryl silicone liquid, a chlorophenylmethyl silicone liquid, a dimethyl silicone liquid and a fluorosilicone liquid are commercially available from Dow Corning Company. Additional useful materials would include polyvinylidene fluoride liquids, polymonochlorotrifluoroethylene liquids, hexafluoropropylene vinylidene fluoride copolymers, perfluoroalkyl polyethers (available under such names as Fomblyn, Krytox, sold by Montecatini-Edison and DuPont, respectively), fluoroalkyl esters, block copolymers of dimethyl siloxane with a variety of materials such as Bisphenol A, tetramethylspirobi(indan)diol and the like. Of course, other fuser agents exhibiting good thermal stability are also useful. Obviously, in selecting an offset-preventing liquid, care should be taken to select a liquid which is chemically compatible with the toner offset preventing layer on which it is applied.

A pressure roller 50 is held in pressure engagement with fuser roller 30 by suitable forceapplying means such as that disclosed in Research Disclosure No. 13,703, Sept. 1975, published by Industrial Opportunities, Ltd., Homewell, Havant, Hampshire, UK. Pressure roller 50 includes a core 52 of metallic material mounted on shaft 54 and an outer layer 56 of material having good toner offset preventing characteristics such as polytetrafluoroethylene, silicone elastomer or fluoroelastomers such as the vinylidene-fluoride based fluoropolymeric elastomers. Rollers 50 and 30 form a nip through which is passed receiver 58 carrying an unfixed toner image 60 on its underside. Through heat and pressure, toner image 60 is fixed permanently to receiver 58 as it passes this nip. Due to the toner offset preventing properties of layers 56 and 38, any fuser oil applied to layer 38 by wick 40, rollers 30 and 50 will not be contaminated by toner from receiver 58 and copy sheet 58 will exit the roller nip without sticking to either of these rollers. Thus, jams and fuser malfunction are obviated.

The lineal pressure between rollers 30 and 50 may vary, but typically is within the range from about 0.05 to about 4 kilograms per centimeter of roller length. The temperature maintained in the nip which serves as the heat fixing zone of the roller fuser is generally within the range of from about 110° to about 260° C. The temperature chosen is a function of the softening temperature of the toner powder, the rate at which the receiver material carrying the toner powder image is passed through the nip of the fuser roller, the length of the nip, and the force of roller engagement.

To further enhance the various properties of fuser roller 30, it may be useful in certain situations to provide various fillers to further enhance thermal properties, mechanical strength, or toner offset preventing properties of the outer layer of the fuser member. Typically, the thick elastomeric layer 32 may contain various fillers such as carbon black or silica for strength and various metal oxides, metal particles, or the like to enhance the thermal conductivity of the elastomeric material. In addition, various plasticizers or the like may be used where necessary or where desirable.

Although fuser roller 30 of FIG. 3 is shown as including an internal heating source such as quartz lamp 62, other internal heating sources may be provided such as a heated liquid or a resistance element located within the roller core. In the alternative, an external source of thermal energy may be provided to heat the surface of fuser roller 30.

Figure 4:
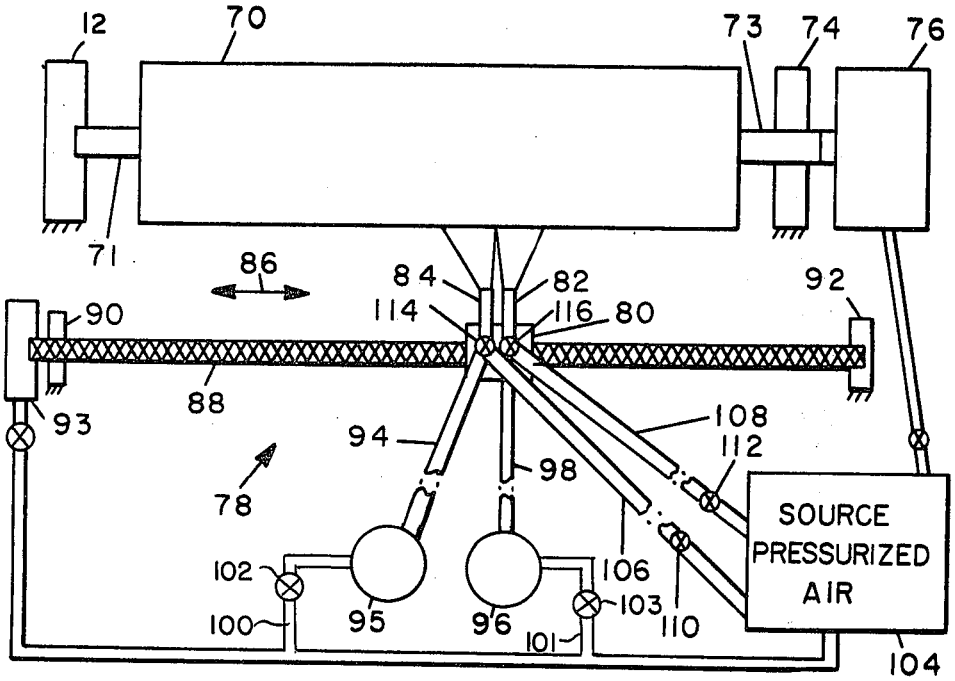
FIG. 4 is an apparatus which may be used in effecting the method of the present invention.

Referring now to FIG. 4, there is shown apparatus which is useful for carrying out the method of the present invention in forming fuser rollers. As shown, a fuser roller 70 to be sprayed according to the method of the present invention is rotatably mounted in bearings 72 and 74 by gudgeons 71 and 73 respectively. A motor 76 is connected to roller 70 to rotate it at a predetermined rotational speed. Spray assembly 78 is provided and includes a carriage 80 upon which are mounted spray heads 82 and 84. Carriage 80 is driven for movement in directions 86 by means of screw thread 88 rotatably mounted in bearings 90 and 92 and driven by motor 93. The spray area of spray heads 82 and 84 are contiguous. Spray head 84 is supplied with first material to be sprayed from reservoir 95 by means of flexible conduit 94. In like manner, spray head 82 is supplied with second material to be sprayed from reservoir 96 by means of flexible conduit 98. A source 104 of pressurized fluid such as air provides pressure to drive fluid motors 76 and 93 to provide a pneumatic source for spraying materials from spray heads 84 and 82 and to provide pressure to reservoirs 95 and 96. Conduits 100 and 101 having regulators 102 and 103 supply pressurized air to reservoirs 95 and 96 respectively. Conduits 106 and 108 supply pressurized air to spray heads 84 and 82 respectively. Valves 110 and 112 control the amount of air supplied over conduits 106 and 108 respectively, while valves 114 and 116 control the actuation of spray heads 84 and 82.

Following is a description of the formation of a fuser roller 70 according to the method of the present invention using the apparatus of FIG. 4. The spraying operation is carried out at ambient temperature but both temperature and humidity are preferably controlled to avoid extremes of either or both. Fuser roller 70 will be assumed to have a final structure in accordance with the multi-layer roller shown in FIG. 2. In such case, the fuser roller may comprise first and third layers of silicone elastomer and a second layer of a fluoroelastomer such the terpolymer of vinylidene fluoride, hexafluoropropylene and tetrafluoroethylene sold under the name of Viton • B by the DuPont Company. The latter material is highly impervious to silicone fuser oil and is resistant to degradation while operating at high temperatures in the range of 100°-200° C. Silicone elastomer is also highly resistent to deterioration at high operating temperatures but exhibits a greater tendency to absorb silicone fuser oils thus causing undesirable swelling and formation of steplike patterns over prolonged use. Thus, the first layer is formed of silicone elastomer and provides the thickest layer of the multilayer fuser roller. The third layer in contact with a toner image is of silicone elastomer since silicone generally has better offset preventing characteristics than vinylidene fluoride based fluoroelastomer. The second layer of fluoroelastomer provides a barrier layer to prevent absorption of fuser oil by the first elastomer layer.

Reservoirs 95 and 96 should contain sufficient quantities of silicone elastomer and fluoroelastomer so that fuser roller 70 may be formed without replenishment of reservoirs 95 and 96 during the spraying process. Where several fuser rollers are to be made in succession, the capacity of reservoirs 95 and 96 should be great enough so that they need be replenished less frequently in order to maintain productivity.

An exemplary fuser roller 30 may, for example, include a core 32 of aluminum having an outside diameter of three inches. A first layer of silicone elastomer of forty to eighty thousandths of an inch thickness is initially applied to the core. A second layer of fluoroelastomer material which is resistent to silicone fuser oil and which is approximately two to five thousandths of an inch thick is subsequently sprayed on the silicone elastomer layer according to the method of the present invention. A third layer of ten to twenty thousandths of an inch of silicone elastomer is then applied to the fluoroelastomer layer by means of the method of the present invention.

A fuser roller is formed by the apparatus of FIG. 4 as follows:

An aluminum cylinder 70 which may be pretreated to promote adhesion of the silicone elastomer is rotatably mounted in bearings 72 and 74 by means of gudgeons 71 and 73. Motor 76 is connected to gudgeon 73 and causes cylinder 70 to rotate at a predetermined velocity. Simultaneously, motor 94 causes spray heads 84 and 82 carried by carriage 80 to move back and forth across cylinder 70 as it is rotated by motor 76. The rotational velocity of roller 70 and velocity of carriage 80 are synchronized to effect the desired buildup of layers on roller 70. Layer buildup is also a function of the rate of spraying by spray heads 84 and 82 and of the characteristics of materials being sprayed.

As roller core 70 is rotated and carriage 80 is caused to move back and forth across the width of roller 70, silicone elastomer is sprayed upon core 70 to build up the first layer to the desired thickness of, e.g. forty thousandths of an inch. Since spraying techniques might require an unnecessarily long time for building up such a thickness, it may be desirable to provide a core 70 upon which a layer of silicone elastomer has already been formed by other techniques such as molding. Then, only an initial thin layer of silicone elastomer need be applied over this layer so that the time required for spraying is substantially reduced or a mixture of silicone elastomer and fluoroelastomer may be sprayed immediately on the silicone layer.

After the desired thickness of silicone elastomer has been sprayed onto core 70, silicone elastomer is continued to be sprayed upon roller 70, valve 116 is gradually opened to actuate spray head 82. Valve 114 which has been fully opened during spraying of silicone elastomer only by head 84 is now gradually closed as valve 116 is gradually opened so that the mixture of the silicone elastomer and fluoroelastomer sprayed by heads 84 and 82 will gradually vary from only silicone elastomer being sprayed to only fluoroelastomer being sprayed. When only fluoroelastomer is being sprayed, valve 114 will have been closed, valve 116 will be fully opened, and fluoroelastomer will continue to be sprayed until the desired thickness of the floroelastomer layer is built up.

To build up an outer layer of silicone elastomer, the reverse process is now effected. As fluoroelastomer is continued to be sprayed upon roller 70 silicone elastomer is progressively added to the spray mixture until only silicone elastomer is being sprayed to a desired thickness. The multilayer fuser roller is then removed from the spraying apparatus and cured by known curing techniques as will be more fully evident to those skilled in the art from the hereinafter described example.

Figure 5:
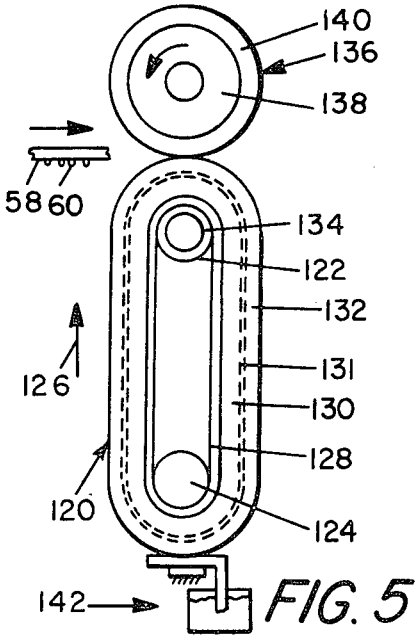
FIG. 5 is another embodiment of the fuser member of the present invention.

Referring now to FIG. 5, there is shown another embodiment of the present invention. As shown, a belt 120 is disposed about rollers 122 and 124 for movement in the direction of arrow 126. Belt 120 comprises a support layer 128 of heat conductive material such as metal. Upon layer 128 is bonded heat conductive elastomeric layer 130 of suitable material such as silicone elastomer. Also provided are outer layer 132 of fuser oil-impervious elastomer such as a vinylidene fluoride based elastomer Viton• and layer 131 intermediate to and continuous with layers 130 and 132 in which the proportion of the silicone elastomer to the fuser-oil impervious elastomer gradually varies from substantially only silicone elastomer to substantially only oil impervious elastomer. Positioned within roller 122 is a source of heat such as quartz tube 134. A pressure roller 136 has a core 138 and an outer layer 140 of toner offset preventing material such as polytetrafluoroethylene. A wicking assembly 142 applies fuser oil to the outer surface of layer 132 to prevent offsetting of toner particles from processed receivers onto belt 120. In operation, a receiver 58 carrying a toner image 60 on its lower side is moved through the nip between pressure roller 36 and heated fuser belt 120 to permanently fix image 60 to receiver 58.

Figure 6:
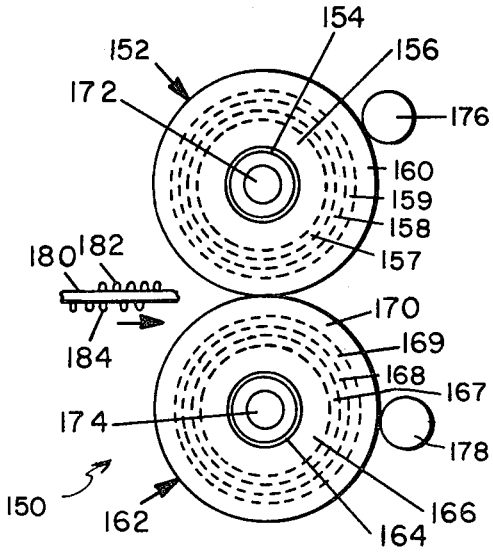
FIG. 6 is a fuser roller incorporating two fuser members according to the embodiment of FIG. 2 in fixing duplex images to a receiver.

Referring now to FIG. 6, there is shown another embodiment of the present invention wherein duplex images on a copy sheet are fixed by a pair of fuser rollers made according to the present invention. As shown, a roller fuser 150 includes a pair of identical rollers made according to the embodiment of FIG. 2. Upper fuser roller 152 includes a heat conductive core 154 upon which is bonded a first layer 156 of silicone elastomer of desired thickness, a second layer 158 of a silicone fuser oil-impervious fluoroelastomer and a third outer layer 160 of silicone elastomer. Gradually varying layers 157 and 159 according to the present invention are respectively intermediate to and continuous with layers 156, 158 and layers 158, 160. Lower roller 162 is identical to roller 152 and includes heat conductive core 164, first layer 166 of silicone elastomer, second layer 168 of oil-impervious fluoroelastomer and third layer 170 of silicone elastomer. Gradually varying layers 167 and 169 according to the present invention are respectively intermediate to and continuous with layers 166, 168 and 168, 170.

Disposed within rollers 152 and 162 are heat sources such as quartz tubes 172 and 174 respectively. Fuser oil such as dimethyl may be applied to the surfaces of rollers 152 and 162 by applicator rollers 176 and 178 respectively.

A copy sheet 180 having unfixed images 182 and 184 on opposite sides thereof is passed through the nip formed by rollers 152 and 162 which are held in pressure engagement with each other. The temperature and pressure of fixing the fuser images is a function, among other, of the characteristics of the toner material and the amount of time that the toner images are in the nip formed by rollers 152, 162.

EXAMPLE

The following is an example of a fuser roller according to the present invention which showed excellent release and fusing qualities. The fuser roller processed approximately 600,000 unimaged copy sheets copies without appreciable step formation in the outer surface layer and without delamination between the layers of the roller. The fuser roller was produced by means of apparatus similar to that shown in FIG. 4. The fuser roller included a core of aluminum which had formed thereon a first layer of a polydimethylsiloxane silicone elatomer available from the Emerson Cumming Co. under the formula No. EC4952. In order to enhance thermal conductivity, the silicone elastomer is filled with thermally conductive materials such as aluminum oxide and iron oxide. According to the method of the present invention, silicone elastomer was initially sprayed onto the first layer to form an intimate layer therewith. As silicone elastomer was continued to be sprayed, a fluoroelastomer comprising a terpolymer of vinylidene fluoride, hexafluropropylene and tetrafluoroethylene (VITON• B50 available from DuPont) was gradually added to the spray mixture until only the fluorelastomer was sprayed to a desired thickness to provide a barrier layer to absorption of fuser oil into the silicone elastomer layer. Then, as the fluoroelastomer only was continued to be sprayed, silicone elastomer was gradually added to the spray mixture until only silicone elastomer was sprayed to build up a layer of silicone elastomer which would provide good release characteristics for the fuser roller.

The silicone elastomer and fluoroelastomer were prepared for spraying as follows:

1. To a mixture of 150 grams of the low-boiling point solvent methylethylketone and 50 grams of the high-boiling point solvent methylisobutylketone was added 400 grams of Emerson Cummings polydimethylsiloxane silicone elastomer identified as Emerson Cummings formula No. EC4952. Just prior to spraying, two grams of a catalyst were added to the silicone elastomer mixture.

2. A mixture of 30 grams of carbon black, 100 grams of methylethylketone solvent, 200 grams of methylisobutylketone solvent, and 10 grams of magnesium oxide acid acceptor were mixed together well and filtered to remove gross particles. To the filtered mixture was added 100 grams of methylisobutylketone solvent and 100 grams of a fluoroelastomer comprising a low viscosity terpolymer of vinylidene fluoride, hexafluoropropylene, and tetrafluoroethylene available from the DuPont Company as VITON• B50. This solution was then mixed on a ball mill for two hours. A separately mixed solution of 3 grams of Cure 20 (a cure agent comprising 33% organophosphonium and 67% fluoroelastomer), 4 grams of Cure 30 (a cure agent comprising 50% dihydroxyaromatic compound and 50% fluoroelastomer), 50 grams of methylethylketone solvent and 100 grams of methylisobutylketone solvent were separately mixed and added shortly before spraying. This mixture was filtered and the filtered mix thinned by means of the addition of 150 grams of methylethylketone solvent and 200 grams of methylisobutylketone solvent. The thinned fluoroelastomer was then suitable for spraying. Production of a multilayer fuser roller according to the present invention was effected by means of a two-head spray apparatus similar to that shown in FIG. 4 as follows:

A roller which included a cylindrical aluminum core having a 0.040" base layer of silicone elastomer was mounted and rotated rapidly while the two spray guns were reciprocated across the length of the roller. The rotational speed of the roller, the lateral speed of the spray guns, and the rate of flow of the elastomeric material being sprayed were synchronized so that the entire surface of the roller was covered with a coating during each spray cycle (a cycle being effected during a back-and-forth reciprocation of the spray heads).

A gradually varying mixture of silicone elastomer and vinylidene-fluoride based fluoroelastomer were applied to the rotating roller by the two spray heads in the following pattern of elastomer mixture, each spray head being supplied with the indicated proportion of elastomer.

TABLE I

| Cycle No. | Silicone Elastomer | Fluoro-Elastomer |
|---|---|---|
| 1 | 8/8 | 0 |
| 2 | 8/8 | 1/8 |
| 3 | 8/8 | 2/8 |
| 4 | 8/8 | 3/8 |
| 5 | 8/8 | 4/8 |
| 6 | 8/8 | 5/8 |
| 7 | 8/8 | 6/8 |
| 8 | 8/8 | 7/8 |
| 9 | 8/8 | 8/8 |
| 10 | 7/8 | 8/8 |
| 11 | 6/8 | 8/8 |
| 12 | 5/8 | 8/8 |
| 13 | 4/8 | 8/8 |
| 14 | 3/8 | 8/8 |
| 15 | 2/8 | 8/8 |
| 16 | 1/8 | 8/8 |

TABLE I-continued

| Cycle No. | Silicone Elastomer | Fluoro-Elastomer |
|---|---|---|
| 17 | 0 | 8/8 |

Thereafter, thirty cycles of fluoroelastomer only was sprayed onto the roller. An outer layer of silicone elastomer was formed on the fluroelastomer layer by reversing the gradually varying spray cycle of Table I as follows:

TABLE II

| Cycle No. | Silicone Elastomer | Fluoro-Elastomer |
|---|---|---|
| 1 | 0 | 8/8 |
| 2 | 1/8 | 8/8 |
| 3 | 2/8 | 8/8 |
| 4 | 3/8 | 8/8 |
| 5 | 4/8 | 8/8 |
| 6 | 5/8 | 8/8 |
| 7 | 6/8 | 8/8 |
| 8 | 7/8 | 8/8 |
| 9 | 8/8 | 8/8 |
| 10 | 8/8 | 7/8 |
| 11 | 8/8 | 6/8 |
| 12 | 8/8 | 5/8 |
| 13 | 8/8 | 4/8 |
| 14 | 8/8 | 3/8 |
| 15 | 8/8 | 2/8 |
| 16 | 8/8 | 1/8 |
| 17 | 8/8 | 0 |

Thereafter, twenty cycles of silicone elastomer only was sprayed onto the roller. The roller was allowed to dry overnight. The next day 65 cycles of silicone elastomer only was sprayed onto the previous silicone elastomer layer.

The roller was then air cured at room temperature overnight. The next day the roller was post cured as follows: 1 hour at 60° C.; 1 hour at 100° C.; 1 hour at 150° C.; 59 hours at 205° C.

This roller was then mounted on a fuser roller fixture with a roller having an aluminum core and an outer layer of 0.010" of silicone elastomer EC4952. Silicone fuser oil was applied to the surface of both rollers. The rollers were internally heated to a core temperature of 340° F. and a nip force of 18 pounds per lineal inch of roller length was applied to the rollers. Blank copy sheets were fed into the nip of the rollers at a rate of over 5000 sheets per hour.

After 600,000 sheets were passed through by the fuser roller, step growth in the multilayer roller was found to be one-half of that expected to be found in a fuser roller having a single silicone elastomer layer of comparable thickness. Adhesion between the fluoroelastomer layer and silicone base layer was found to be comparable both before and after processing, indicating no deterioration in the adhesion between these layers after the 600K sheets were processed.

The invention has been described in detail with particular reference to the preferred embodiment thereof, but it will be understood that variations and modifications can be effected within the spirit and scope of the invention.

What is claimed is:

1. The method of forming a member for fusing toner images to a receiver, comprising:

spraying a base member with a first material which is an elastomer;

after a layer of the first material has been formed continuing to spray said first material while spraying a gradually varying proportion of a second material with said first material until only said second material is sprayed; and continuing to spray said second material only to form a layer of said second material.

2. The method of forming a member for fusing toner images to a receiver, comprising:

spraying a base member with a first material which is an elastomer;

after a layer of the first material has been formed continuing to spray said first material while spraying a gradually varying proportion of a second material with said first material until only said second material is sprayed, said second material being impervious to absorption of fuser oil which is absorbed by said first material; and continuing to spray only said second material to form a layer of said second material which acts as a barrier to absorption of fuser oil by said first material.

3. The method of claim 2 including continuing to spray said second material while simultaneously spraying a gradually varying proportion of a third material which prevents offset of toner thereto; and continuing to spray only said third material to form a layer thereof which contacts a toner image to be fused to a receiver.

4. The method of claim 2 wherein said second material is an elastomer.

5. The method of claim 2 wherein said first and second materials are high temperature resistant elastomers.

6. The method of claims 2, 3, 4 or 5 wherein said first material is a silicone material and said second material is a fluoropolymeric-based material.

7. The method of claim 5 wherein said first material is a silicone elastomer and said second material is a fluoroelastomer including fluorosilicone elastomers and vinylidene-fluoride based fluoropolymeric elastomers.

8. The method of claim 7 wherein said second material is selected from the group consisting of the copolymer of vinylidene fluoride and hexafluoropropylene and the terpolymer of vinylidene fluoride, hexafluoropropylene and tetrafluoroethylene.

9. The method of claim 3 wherein said first and third material comprise silicone elastomer and said second material comprises a fluoroelastomer.

10. The method of claim 9 wherein said fluoroelastomer comprises a vinylidene-fluoride based fluoropolymeric elastomer.

11. The method of claims 1 or 2 wherein said member comprises a roller and includes rotating said roller while spraying said materials thereon.

12. The method of claims 1 or 2 wherein said second material is sprayed in a gradually increasing proportion of said second material to said first material until only said second material is sprayed.

13. The method of claims 4, 5, 7, 8, 9, or 10 including curing said member after completion of said spraying of said elastomer materials.

14. The method of claims 4, 5, 7, 8, 9, or 10 wherein prior to spraying said first and second elastomer materials are respectively dissolved in the same solvent or solvents or in solvents in which both elastomers are soluble.

15. A member for fusing toner images to a receiver comprising:

a composite layer including:

(1) a first layer of a first material which is an elastomer;
(2) a second layer of a second material different from the first material; and
(3) a layer intermediate to and continuous with said first and second layers in which the proportion of the first material to the second material gradually varies from substantially only the first material to substantially only the second material.

16. A member for fusing toner images to a receiver comprising:
a composite layer including:
(1) a first layer of a first material which is an elastomer;
(2) a second layer of a second material which is resistant to absorption of fuser oil which is absorbed by said first material; and
(3) a layer intermediate to and continuous with said first and second layers in which the proportion of the first material to the second material gradually varies from substantially only the first material to substantially only the second material.

17. The member of claim 16 wherein said second material is an elastomer.

18. The member of claim 16 wherein said first and second materials are high temperature resistant elastomers.

19. The member of claims 16, 17 or 18 wherein said first material is a silicone material and said second material is a fluoropolymeric-based material.

20. The member of claim 18 wherein said first material is a silicone elastomer and said secnd material is a fluoroelastomer selected from the group consisting of fluorosilicone elastomer and vinylidene-fluoride based fluoropolymeric elastomers.

21. The member of claim 16 wherein said composite layer includes a third layer of a third material which prevents offset of toner thereto and a layer intermediate to and continuous with said second and third layers in which the proportion of the second material to the third material gradually varies from substantially only the second material to substantially only the third material.

22. The member of claim 21 wherein said toner offset preventing material is a silicone elastomer.

23. The member of claim 16 wherein the thickness of said first layer is substantially greater than the thickness of said second layer.

24. The member of claims 15 or 16 wherein the proportion of the first material to the second material in said intermediate layer gradually increases from substantially none of said second material to substantially all of said second material.

25. The member of claims 15, 16, 17, 18, 20, 21, 22 or 23 wherein said member has been cured.

26. The member of claims 17, 18 or 20 wherein prior to spraying said first and second elastomer materials are respectively dissolved in the same solvent or solvents in which both elastomers are solvent.

27. A fuser roller for fusing toner images to a receiver comprising:
a cylindrical core;
a composite layer on said core including:
(1) a first layer of a first material which is an elastomer;
(2) a second layer of a second material which is resistant to absorption of release oil which is absorbed by said first materal; and
(3) a layer intermediate to and continuous with said first and second layers in which the proportion of the first material to the second material gradually varies from substantially only the first material to substantially only the second material.

28. The roller of claim 27 including a second roller forming a nip with said first roller through which is passed a receiver carrying at least one toner image to be fused by said rollers.

29. The roller of claim 27 wherein said core comprises a cylindrical shell of heat conductive or heat transmissive material and inluding a source of heat located within said shell.

30. The roller of claim 27 wherein said second material is an elastomer.

31. The roller of claim 27 wherein said first and second materials are high temperature resistant elastomers.

32. The roller of claims 27, 30 or 31 wherein said first material is a silicone elastomer and said second material is a fluoropolymeric-based elastomer.

33. The roller of claim 31 wherein said first material is a silicone elastomer and said second material is a fluoroelastomer selected from the group consisting of fluorosilicone elastomer and vinylidene-fluoride based fluoropolymeric elastomers.

34. The roller of claim 27 wherein said composite layer includes a third layer of a third material which is an elastomer which prevents offset of toner thereto and a layer intermediate to and continuous with said second and third layers in which the proportion of the second material to the third material gradually varies from substantially only the second material to substantially only the third material.

35. The roller of claim 34 wherein said first and third materials are silicone elastomers and said second material is a vinylidene-fluoride based fluoropolymeric elastomer.

36. The fuser roller of claim 27 wherein the proportion of the first materal in said intermediate layer gradually increases from substantially none of said second material to substantially all of said second material.

37. The fuser roller of claims 27, 28, 29, 30, 31, 33, 34, 35 or 36 wherein said fuser roller has been cured.

38. The fuser roller of claims 30, 31, 33 or 35 wherein prior to spraying said first and second elastomer materials are respectively dissolved in the same solvent or solvents or in solvents in which both elastomers are soluble.

39. The method of fusing a heat-softenable toner image to a receiver which comprises
pressure contacting a heat-softenable toner image carried by a receiver with a fusing member at a temperature effective to fuse said toner image to said receiver member, said fuser member having a composite layer including:
(1) a first layer of a first material which is a high-temperature resistant elastomer;
(2) a second layer of a second material which is a high-temperature resistant elastomer; and
(3) a layer intermediate to and continuous with said first and second layers in which the proportion of the first material to the second material gradually varies from substantially only said first material to substantially only said second material.

40. The method of claim 39 including applying fuser oil to said fuser member.

* * * * *